US005724687A

United States Patent [19]

Kim

[11] Patent Number: 5,724,687

[45] Date of Patent: Mar. 10, 1998

[54] JADE PILLOW

[76] Inventor: Young Ho Kim, 3959 W. 182nd St., Apt. 234, Torrance, Calif. 90504

[21] Appl. No.: 688,951

[22] Filed: Jul. 31, 1996

[51] Int. Cl.[6] ..... A47C 20/00

[52] U.S. Cl. ..... 5/944; 5/630; 5/633; 601/134

[58] Field of Search ..... 601/115, 122, 601/128, 134; 5/944, 933, 630; D24/200, 211, 214, 215

[56] References Cited

U.S. PATENT DOCUMENTS

| | | | |
|---|---|---|---|
| 3,829,917 | 8/1974 | De Laittre et al. . | |
| 3,840,918 | 10/1974 | Shave . | |
| 4,169,466 | 10/1979 | Wong | 601/134 |
| 4,320,543 | 3/1982 | Dixon . | |
| 4,513,462 | 4/1985 | Thomas . | |
| 4,605,582 | 8/1986 | Sias et al. | 5/944 |
| 4,660,239 | 4/1987 | Thomas . | |
| 4,683,601 | 8/1987 | Lagin . | |
| 4,809,374 | 3/1989 | Saviez | 5/420 |
| 5,080,090 | 1/1992 | Liau et al. | 601/134 |
| 5,105,490 | 4/1992 | Shek | 5/944 |
| 5,347,668 | 9/1994 | Manning . | |
| 5,367,731 | 11/1994 | O'Sullivan . | |
| 5,551,951 | 9/1996 | Fradkin | 601/122 |

FOREIGN PATENT DOCUMENTS

| | | | |
|---|---|---|---|
| 2135202 | 8/1984 | United Kingdom | 601/128 |

*Primary Examiner*—Steven N. Meyers
*Assistant Examiner*—Tuyet-Phuong Pham
*Attorney, Agent, or Firm*—Eugene Oak

[57] ABSTRACT

A therapeutic cushion with detachable jade protrusions comprises a removable lattice of cylindrical members, an outer cover, and cushion fill. The removable lattice of cylindrical members are attached to a plurality of other cylindrical members in a uniform fashion by a plurality of threads which are interwoven through each member, forming a symmetrical lattice. The lattice is placed inside the outer cover and the plurality of cylindrical members are pressed through the plurality of apertures. The cushion fill is also placed inside the outer cover which presses against the lattice thereby maintaining the plurality of cylindrical members within said plurality of apertures. The outer cover is then sealed by a zipper to maintain the cushion fill and the lattice in place. The result is a cushion with a plurality of protrusions made of jade extending from the cushion, providing a massaging and therapeutic effect.

1 Claim, 2 Drawing Sheets

JADE PILLOW

BACKGROUND OF THE INVENTION

1. Field of the Invention

The present invention relates generally to the field of pillows, cushions, and massaging products, specifically to cushions which are textured to provide a massaging effect.

2. Description of the Prior Art

The prior art teaches a plurality of variations of therapeutic cushions and pillows. U.S. Pat. No. 5,367,731 to O'Sullivan discloses a two-sided pillows that is capable of providing different degrees of support to a user's neck. The pillow fill is enclosed between a first and third panel. An exterior depression is formed in the central region of the first panel, and the central region of the third panel is supported in a substantially flat position.

U.S. Pat. No. 4,660,239 to Thomas discloses a therapeutic pillow which comprises a soft resilient bottom pillow section and a top pillow section thereover and peripherally interconnected. The top section includes top and bottom fabric covers peripherally interconnected with a pair of rows of stitching spaced from the ends of the pillow sections, and a transverse stitching between the rows of stitching interconnecting the covers defining a first tubular neck support of rectangular shape and a pair of laterally spaced supplemental neck supports of rectangular shape.

U.S. Pat. No. 4,513,462 to Thomas discloses a therapeutic pillow comprising a soft resilient bottom pillow section and a top pillow section thereover and peripherally interconnected. The top section includes top and bottom fabric covers peripherally interconnected with interior stitching spaced from the sides of the pillow sections interconnecting the covers defining a first tubular neck support of rectangular shape and a supplemental neck support of U-shape.

U.S. Pat. No. 3,840,918 to Shave discloses a pillow which is adapted for the application of special temperature conditions to the head and neck areas of the user, and for the support of the neck vertebrae. A covering envelope for the pillow has a flap provided with a pocket adapted to receive temperature-establishing means such as a heat pad or an ice pack. The position of the pocket is such as to place it above the head of the user during his sleep.

U.S. Pat. No. 3,829,917 to De Laittre, et al. discloses a therapeutic pillow for head and neck support of a user in a horizontal resting position on a supporting surface wherein a homogeneous, integral, generally elongated pad of resilient foam rubber-like material includes a pair of user supporting lobes on an upper face thereof, the lobes being separated by a trough there-between and the lobes extending the length of the elongated dimension of the pad and overhanging the pad therealong such that when the head and neck of a user are placed on the upper face, they cause the overhanging portion of one of said lobes under and adjacent the user to stretchedly roll toward the supporting surface and outwardly from the pad to a position contacting the surface.

U.S. Pat. No. 4,683,601 to Lagin discloses a medical pillow for use by patients who have recently undergone an open heart surgical type operation which facilitates and eases pain associated with coughing for the expectoration of phlegm from their lungs.

U.S. Pat. No. 4,320,543 to Dixon discloses a medical pillow providing stabilized support for the head and neck of the user and incorporating a convoluted upper surface. The pillow is typically rectangular and has a generally flat bottom and a contoured top.

U.S. Pat. No. 5,347,668 to Manning discloses a head support device to be used in cooperation with a treatment table for humans such as a chiropractic or therapeutic table.

Although the prior art teaches several variations of pillows and cushions, none teach a therapeutic cushion with detachable jade protrusions as disclosed by the present invention.

Accordingly, the principle object of the present invention is to provide a therapeutic cushion wherein a pattern of jade protrusions are affixed to the same, thereby providing a massaging effect to the user.

Another object of the present invention is to provide a therapeutic cushion wherein said pattern of jade protrusions are removable.

Yet another object of the present invention is to provide a therapeutic cushion which is conveniently disassembled to facilitate the washing of each component of said therapeutic cushion.

A further object of the present invention is to provide a therapeutic cushion which is comfortable.

SUMMARY OF THE INVENTION

The present invention is a therapeutic cushion with detachable jade protrusions which comprises the removable lattice of jade protrusions, the outer cover, and the cushion fill. The removable lattice of jade protrusions comprises a plurality of cylindrical members made of jade, each attached to four other cylindrical members in a uniform fashion by means of a plurality of threads which are interwoven through each member, forming a symmetrical lattice. The outer cover of the therapeutic cushion has a plurality of apertures which correspond to the lattice of jade protrusions. The lattice is placed inside the outer cover and the plurality of cylindrical members are pressed through the plurality of apertures. The cushion fill is also placed inside the outer cover which presses against the lattice thereby maintaining the plurality of cylindrical protrusions within said plurality of apertures. The outer cover is then sealed by means of a zipper to maintain the cushion fill and the lattice of jade protrusions in place. The result is a cushion with a plurality of protrusions made of jade extending from said cushion, providing a massaging and therapeutic effect.

BRIEF DESCRIPTION OF THE DRAWINGS

The following is a brief description of the drawings which should be taken in connection with the detailed description of the preferred embodiment.

DETAILED DESCRIPTION OF THE PREFERRED EMBODIMENT

Figure 1:
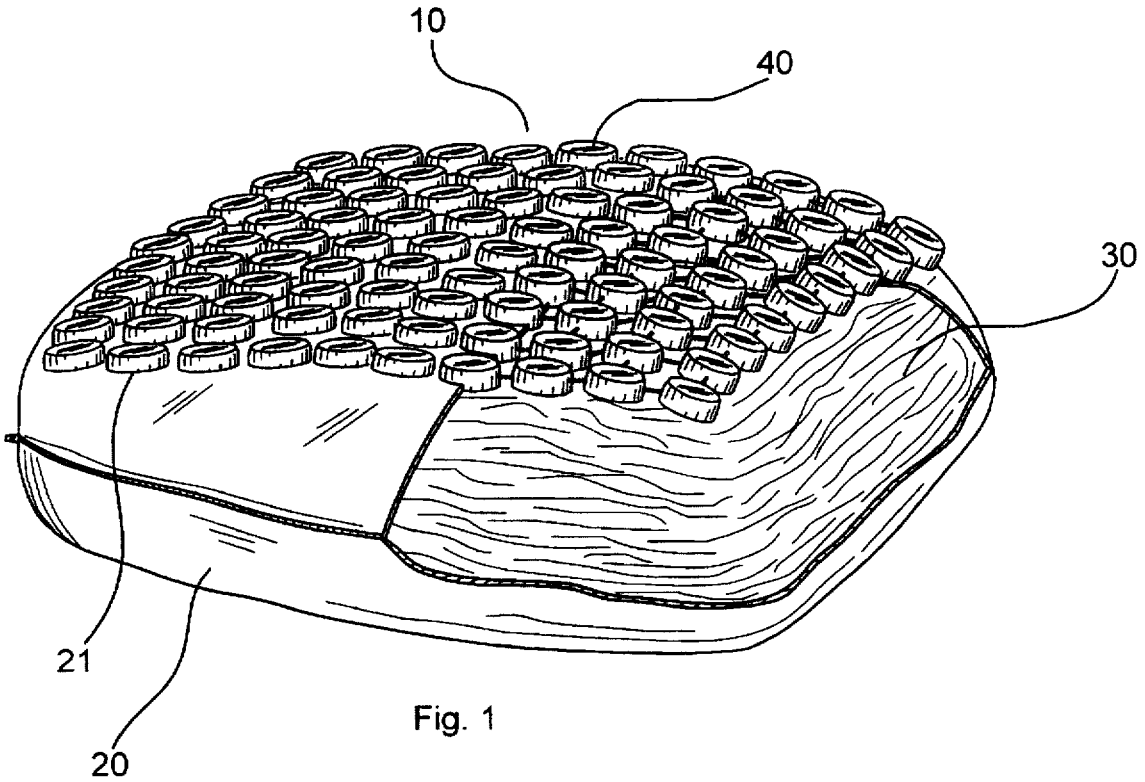
FIG. 1 is a perspective view of the therapeutic cushion with detachable jade protrusions exposing its inner parts.

Referring to FIG. 1 which is a perspective view of the therapeutic cushion 10 exposing its inner parts, the present invention comprises an outer cover 20, cushion fill 30, and a lattice of cylindrical members 40. The lattice of cylindrical members 40 and the cushion fill 30 are removable from the outer cover 20 to facilitate washing of the outer cover 20. The outer cover 20 has a plurality of apertures 21 which accommodate the lattice of cylindrical members 40 and hold the lattice 40 in place. In addition, the cushion fill 30 is disposed within the outer cover 20, pressing against the lattice and therefore keeping the lattice 40 in place as well.

Figure 2:
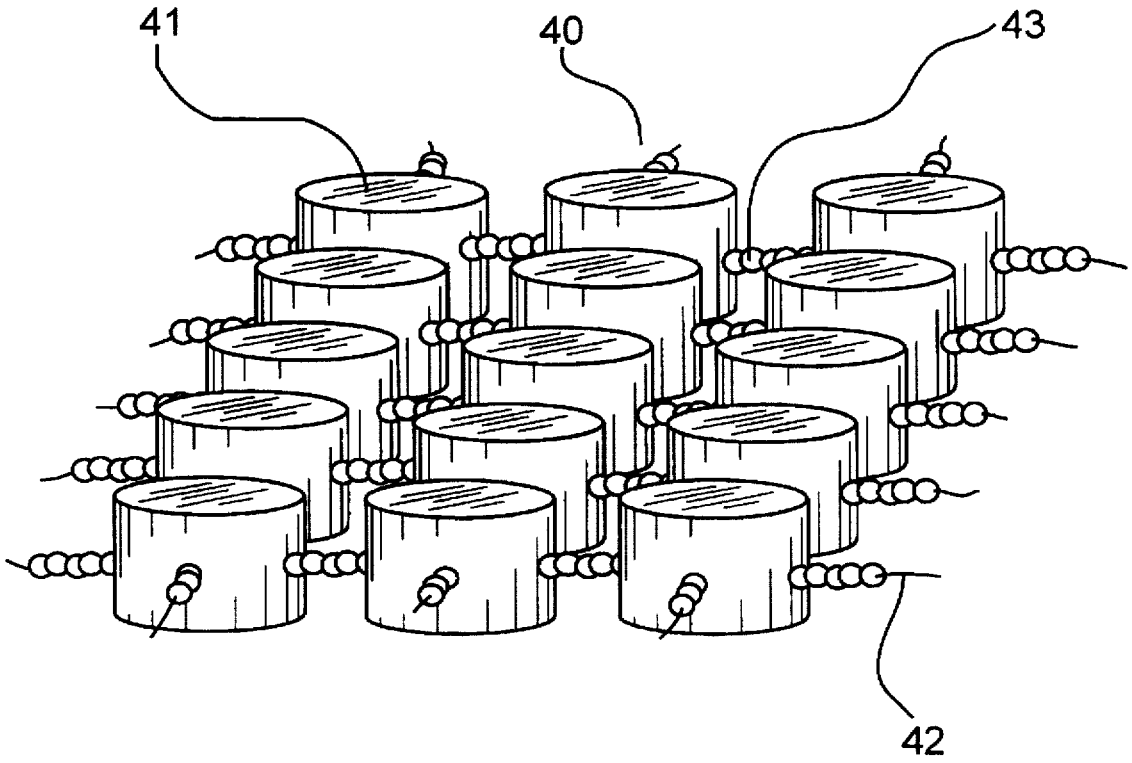
FIG. 2 is a top plan view of the lattice of the cylindrical members made of jade.

Referring to FIG. 2 which is a close-up perspective of the lattice of cylindrical members 40, the lattice of cylindrical members 40 comprises a plurality of individual cylindrical members 41 which are interconnected, each member connected to four other cylindrical members 41 by means of an interwoven thread 42. Along each thread 42 and disposed between consecutive cylindrical members 41 are a plurality of beads 43 which prevent the cylindrical members 41 from sliding along the thread 42 and which also restrict the flexibility of the lattice 40. The beads 43 also protect the thread 42 from being severed, thereby extenuating the longevity of the therapeutic cushion 10.

What is claimed as being new and therefore desired to be protected by Letter Patent of the United States is as follows:

1. A therapeutic cushion comprising an outer cover, cushion fill, and a quadrangular lattice of cylindrical members, wherein said cushion fill and said quadrangular lattice of cylindrical members are disposed within said outer cover, wherein said cushion fill and said quadrangular lattice of cylindrical members are removable from said outer cover:

a) said quadrangular lattice of cylindrical members comprising a plurality of cylindrical members which are woven together by thread, each of said cylindrical members connected to a plurality of other said cylindrical members, thereby forming said quadrangular lattice of cylindrical members;

1) a plurality of beads being strung along portion of said thread between said cylindrical members preventing said cylindrical members from sliding along said thread; and 2) said cylindrical members being made of jade; and b) said outer cover having a plurality of apertures accommodating said lattice of cylindrical members, and being made of a material which can be easily washed.

* * * * *